US007602668B2

(12) United States Patent
Liang et al.

(10) Patent No.: US 7,602,668 B2
(45) Date of Patent: Oct. 13, 2009

(54) DOWNHOLE SENSOR NETWORKS USING WIRELESS COMMUNICATION

(75) Inventors: Kenneth Kin-nam Liang, New Milford, CT (US); Jacques Jundt, Newton, MA (US); Philippe Salamitou, Paris (FR)

(73) Assignee: Schlumberger Technology Corporation, Ridgefield, CT (US)

( * ) Notice: Subject to any disclaimer, the term of this patent is extended or adjusted under 35 U.S.C. 154(b) by 337 days.

(21) Appl. No.: 11/556,332

(22) Filed: Nov. 3, 2006

(65) Prior Publication Data

US 2008/0106972 A1 May 8, 2008

(51) Int. Cl.
*G01V 1/00* (2006.01)

(52) U.S. Cl. ..... 367/25

(58) Field of Classification Search ..... 367/25, 367/80, 81, 82, 99, 103, 104, 105, 16; 340/853.2, 340/853.3, 853.9, 855.3
See application file for complete search history.

(56) References Cited

U.S. PATENT DOCUMENTS

| | | | | |
|---|---|---|---|---|
| 6,070,662 | A | 6/2000 | Ciglenec et al. | |
| 6,408,943 | B1 * | 6/2002 | Schultz et al. | 166/285 |
| 6,462,672 | B1 * | 10/2002 | Besson | 340/853.2 |
| 6,898,529 | B2 | 5/2005 | Gao et al. | |
| 6,976,535 | B2 | 12/2005 | Aronstam et al. | |
| 7,114,561 | B2 * | 10/2006 | Vinegar et al. | 166/250.01 |
| 7,140,434 | B2 * | 11/2006 | Chouzenoux et al. | 166/250.11 |
| 7,301,474 | B2 | 11/2007 | Zimmerman | |
| 7,453,768 | B2 * | 11/2008 | Hall et al. | 367/82 |
| 2003/0086336 | A1 * | 5/2003 | Dubinsky | 367/76 |
| 2004/0000713 | A1 * | 1/2004 | Yamashita et al. | 257/728 |
| 2004/0060697 | A1 * | 4/2004 | Tilton et al. | 166/253.1 |
| 2004/0238166 | A1 | 12/2004 | Salamitou et al. | |
| 2006/0203613 | A1 * | 9/2006 | Thomsen et al. | 367/38 |
| 2007/0206440 | A1 * | 9/2007 | Fripp et al. | 367/81 |

* cited by examiner

*Primary Examiner*—Jack W. Keith
*Assistant Examiner*—Krystine Saito
(74) *Attorney, Agent, or Firm*—James McAleenan; Jody DeStefanis; Dale Gaudier

(57) ABSTRACT

Sensors located in the vicinity of a hydrocarbon-producing well receive power and communicate with one or more hubs located in the well or at the outer surface of a casing by means of elastodynamic waves. Each hub incorporates a plurality of transducers which permit focusing of the emitted elastodynamic waves. In order to concentrate the energy on a single sensor, or a group of sensors arranged in a cluster. Hubs and sensors communicate by exchanging, modulated elastodynamic waves. Sensors belonging to a cluster may transmit, properly time-shifted elastodynamic waves, in order to collectively focus their energy in the direction of a hub. Time synchronization between the sensors within a cluster may be accomplished by means of electromagnetic fields which travel much faster than elastodynamic waves, but can only propagate over short distances in typical formations.

48 Claims, 8 Drawing Sheets

DOWNHOLE SENSOR NETWORKS USING WIRELESS COMMUNICATION

FIELD OF THE INVENTION

This invention relates generally to oil and gas recovery, and more particularly to exchanging power and data with wireless subterranean sensors.

BACKGROUND OF THE INVENTION

Oil and natural gas are extracted from underground formations by drilling boreholes to reach hydrocarbon-bearing zones. Steel tubing ("casing") is inserted into the borehole, after which cement is pumped into the area between the casing and the borehole wall. The casing and cement prevent the borehole from collapsing under overburden pressure. Production tubing is inserted into the casing to convey the oil and gas to the surface. Sand screens within the casing prevent the ingress of fine rock debris into the well. Collectively, these parts of the well are designated as "the completion."

Various sensors are utilized in oil and gas wells. In order to help improve the productivity of hydrocarbon-producing wells and enhance the recovery factor of reservoirs, it is known to monitor both the motion of the fluids present in the hydrocarbon-bearing zone and other parameters affecting the operation of the completion. In order to monitor these parameters it is desirable to place sensors within the well and also some distance away from the well in the surrounding formation. The sensors measure local physical properties such as pressure, temperature, electrical resistivity, fluid flow rate and fluid composition. Sensors may also be deployed in arrays to detect seismic waves generated by sources located either within the well, within adjacent wells, or at the surface, for the purpose of delineating fluid fronts. Modern wells also incorporate equipment to provide zonal isolation and flow control in separate producing zones, in the form of packers and valves. It is desirable to also monitor the proper operation and health of these elements by embedding sensors in them.

The current trend is a significant increase in the number of sensors in oil and gas wells. With the advent of horizontal drilling it has become possible to expose a relatively long section of the well to the hydrocarbon-bearing zone. In particular, the zone exposure may be kilometers in length. As already described, sensors should be distributed along the hydrocarbon-bearing zone to effectively monitor the behavior of the reservoir. As a result of increased zone exposure, increasingly large numbers of sensors are being installed in wells. In the future, a single well could conceivably incorporate hundreds of sensors dispersed over a substantial volume around the borehole. However, exchanging communication and power with such large numbers of sensors may be impractical with current technology.

It is known to exchange of information and power between devices located on the production tubing and the surface by running electrical wires or optical fibers along the tubing. Significant amounts of power, e.g., hundreds of watts, and high data rates, e.g., hundreds of kilobits per second, can be delivered downhole by this method. Unfortunately, this conventional technique is relatively ineffective at linking devices located on the tubing to sensors located on the fixed parts of the completion, in spite of the relatively short distances involved. Consequently, the sensors, wires and hydraulic lines are often placed on the outer surface of the casing and cemented in place. However, this solution presents many drawbacks. For example, it is only applicable to new wells, it does not allow repairs after installation, and it interferes with the cementing process, frequently leading to a lack of integrity and sealing capability of the cement column.

It is generally known to implement wireless communication for networks of small sensors by means of electromagnetic fields. For example, RF communications are utilized with RF-ID tags for monitoring conditions in buildings. However, such techniques are not practical for the downhole environment because the electrical conductivity of most formations strongly attenuates these fields and hampers their propagation. The presence of a metallic casing, liner or sand screen further degrades communication between devices located inside the borehole and devices located within the formation. Several techniques have been proposed to address the problems. For example, Ciglenec et al. in U.S. Pat. No. 6,070,662 discloses communicating with a sensor shot into the formation by incorporating a miniature battery in the sensor to power a transmitter. However, such a battery has a limited life, perhaps providing only a few days of operation. Aronstam et al. in US patent application publication 2005/0011645 describes small data carriers flowing with the wellbore fluids, which are either pumped continuously from the surface or released from a magazine located downhole. However, the data throughput is relatively low in both cases. Salamitou et al. in US patent application publication 2004/0238166 discloses a miniature sensor which is inserted into a casing hole and remotely powered and interrogated by a device located in the wellbore. However, the sensor must be mounted flush with the casing wall. Gao et al. in US patent application publication 2005/0055162 describes a wireless network of extremely small sensors pumped in fractures. However, it relies on radio waves and thus is limited in its range and cannot operate practically through steel casing. All of such references are herein incorporated by reference.

Despite being the focus of considerable research and development, the large-scale use of sensors downhole is still hampered by two main technical difficulties. One technical difficulty is the exchange of information between the sensors and the surface, and possibly between the sensors themselves. The other technical difficulty is the delivery of suitable amounts of power to the sensors. There is therefore a need for techniques which are not subject to the limitations of currently known techniques for transmitting information and power between a device located in the wellbore and sensors deployed either in the wellbore, within various components of the completion or on their surface, or within the formation some distance away from the borehole.

SUMMARY OF THE INVENTION

The present invention is predicated in-part on recognition that elastodynamic waves can be employed both for subterranean power transfer to a sensor and subterranean communication with that sensor.

In accordance with one embodiment of the invention, a wireless subterranean sensor network comprises: at least one sensor, the sensor including an elastodynamic transducer; and a hub having at least one elastodynamic transducer; wherein a link is formed between the sensor transducer and the hub transducer by elastodynamic waves. The link may be a power supply link, a communication link, and a power/communication link.

In accordance with another embodiment of the invention, a method for operating a wireless subterranean sensor network comprises: with at least one sensor, the sensor including an elastodynamic transducer, and a hub having at least one elastodynamic transducer, forming a link between the sensor transducer and the hub transducer by elastodynamic waves.

The link may be a power supply link, a communication link, and a power/communication link.

DETAILED DESCRIPTION

Figure 1:
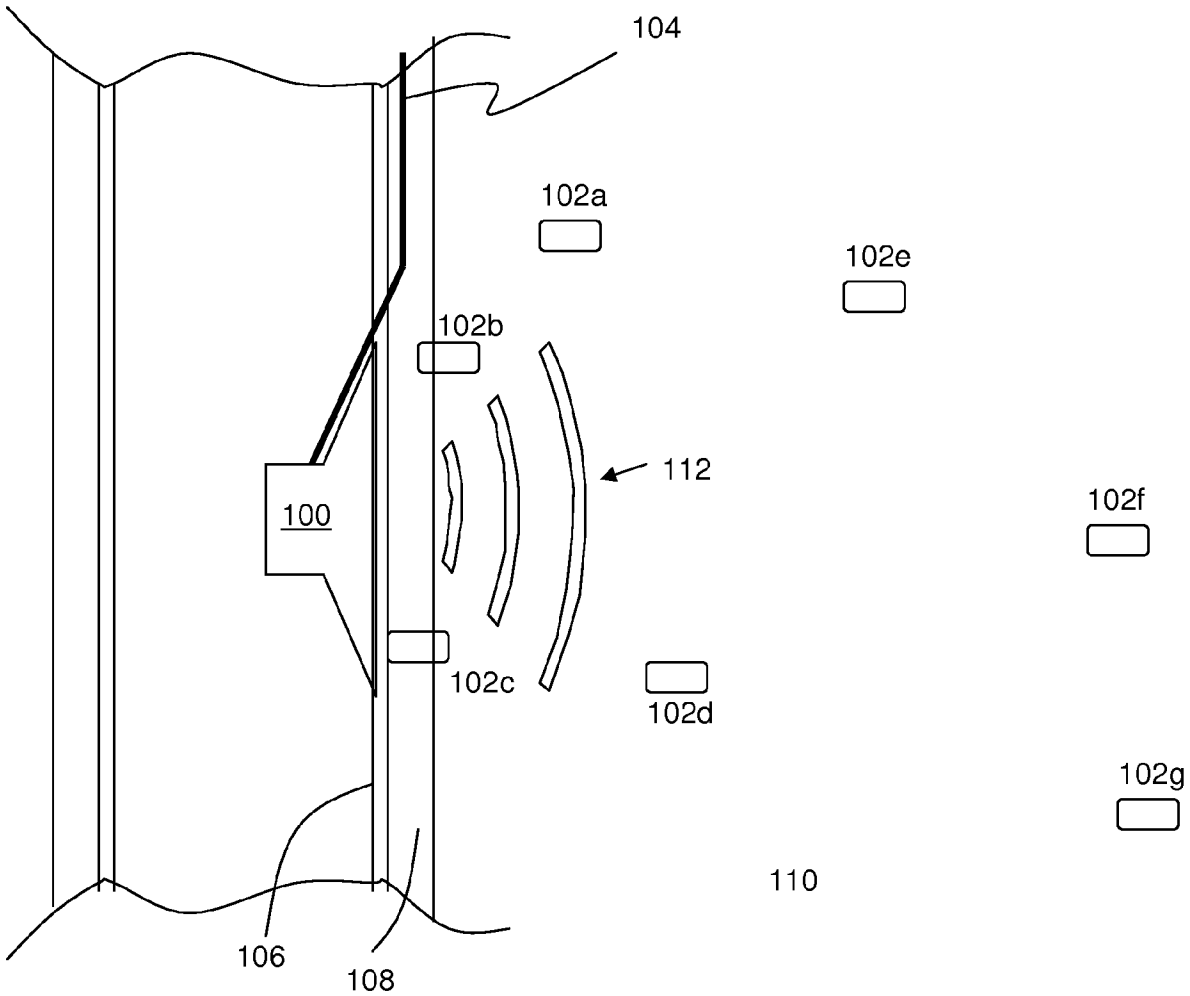
FIG. 1 illustrates a downhole sensor network in which wireless sensors are powered by elastodynamic waves.

Referring to FIG. 1, a downhole sensor network includes a hub (100) and sensing elements ("sensors") (102*a*-102*g*) positioned in the proximity of a well. The hub (100) may be permanently deployed in the well, e.g., without limitation, affixed to the casing (106). A cable (104) conveys power and telemetry signals between the hub (100) and the surface. The sensors are wireless, and may be part of the completion, e.g., disposed against the casing (106) and within the surrounding cement (108), and may also be disposed outside the completion, e.g., deployed in the formation (110) by shooting, pumping, insertion in radially drilled micro-boreholes, or other method known in the art. The hub (100) is operable to generate elastodynamic waves (112) which are propagated into the completion and the formation (110). The sensors utilize energy in the elastodynamic waves to power their operations. Further, by proper modulation of the elastodynamic waves, information can be exchanged between the hub and the sensors. Various embodiments for providing such functionality will be described in greater detail below.

Figure 2:
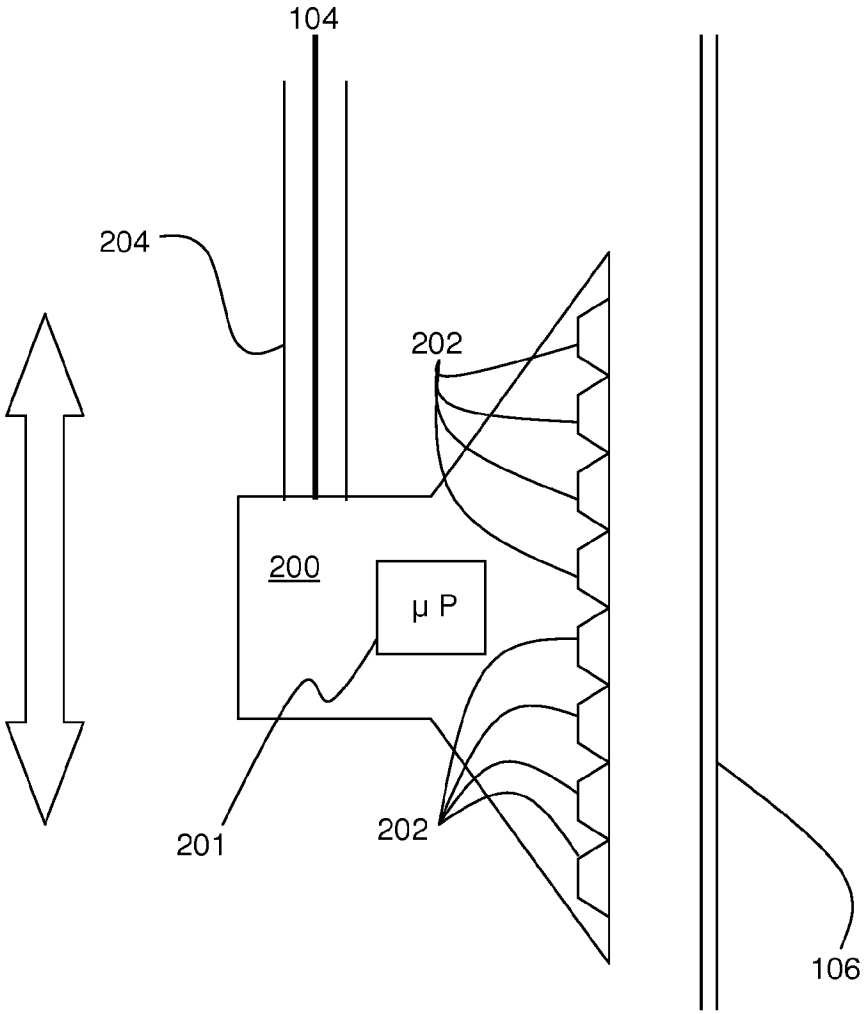
FIG. 2 illustrates one embodiment of the hub of FIG. 1.

Referring now to FIGS. 1 and 2, an alternative embodiment of the hub (200) is inserted into the well at the end of a wireline tool (204). The hub (200) incorporates a plurality of transducers (202) arranged in a two or three dimensional array. The transducers may utilize macro-fiber piezoelectric composite materials which conform to the outer surface of the structure to transmit and receive elastodynamic waves. Electrical signals which drive the transducers of the array can be time-shifted with respect to each other by a processor (201) in order to control the radiation pattern of the array, i.e., to implement beam forming. Beam forming can be used to cause the radiation pattern of the elastodynamic waves generated by the hub to have characteristics ranging from being very wide, such that all sensors will receive the waves, to narrowly focused in the direction of a group of sensors or an individual sensor. In particular, the elastodynamic waves are adjustably controllable in both focus and direction. In order to enhance propagation through the casing (106) and surrounding cement, as shown in FIG. 1 (108), the wavelength $\lambda$ of the elastodynamic waves (112) shown in FIG. 1 may be set such that the integral multiples of length $\lambda/2$ is comparable to the thickness of the casing, or the casing and the surrounding cement, e.g., $\lambda$ of 510 to 612 mm. In order to accommodate the competing requirements of propagation loss, focus, and antenna dimensions, the elastodynamic waves are preferably at ultrasonic frequencies, i.e., greater than 20 KHz. However, the frequency and wavelength may be adjusted to achieve a desired result in each implementation.

It should be appreciated that various options are available for both insertion and positioning of the hub (200). For example, the hub may be inserted with the casing as the completion is being installed, or the hub may be temporarily inserted and later removed after the completion has been installed, or the hub may be either permanently or semi-permanently inserted after the completion has been installed. Further, the hub (200) may be disposed within the mud layer inside the casing, i.e., away from the casing, or the hub may be disposed against the casing, or the hub may be integral to the casing, i.e., a part of the casing. Various means may be employed to attach the hub to the casing, including but not limited to clamps, adhesives, fasteners, and magnetic or electromagnetic features. One advantage of disposing the hub against the casing is that the elastodynamic waves are more directly coupled to the formation in comparison with disposing the hub within the mud layer. Consequently, losses due to reflection and transmission impedance will be reduced.

Figure 3:
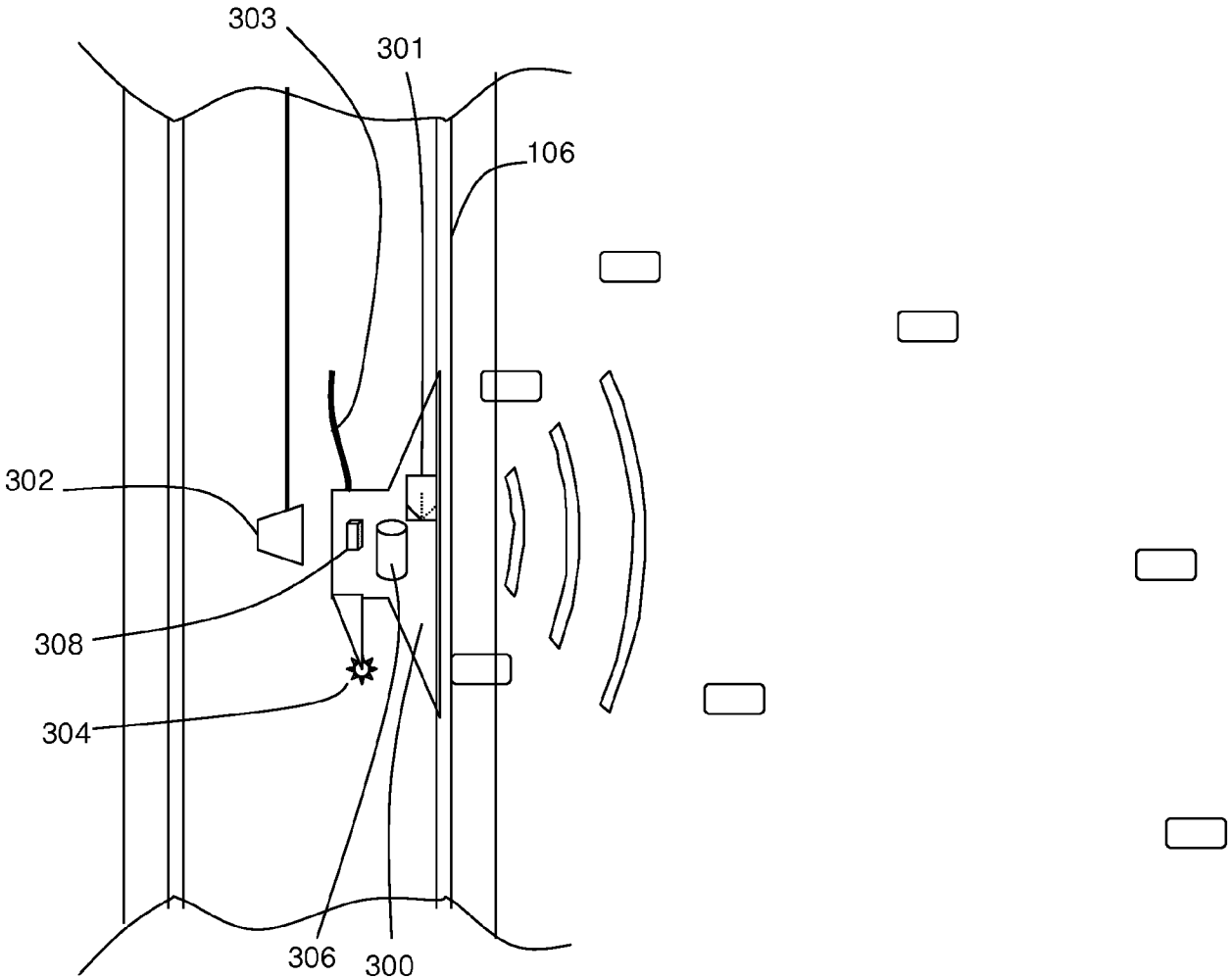
FIG. 3 illustrates an alternative embodiment of the hub.

Referring to FIG. 3, in an alternative embodiment a wireless hub (300) is affixed permanently or semi-permanently to the completion. In the illustrated example, the hub (300) is affixed to the surface of the casing (106). An elastodynamic or RF transducer (302), which is lowered into the well at the end of a wireline, is operable to provide power to the hub and to exchange data with the hub. In particular, the transducer (302) is positioned proximate to the hub and then actuated in order to energize the hub transducers, thereby powering the sensors and receiving data from the sensors. An advantage of this configuration is that it does not require the permanent placement of wires in the cement column outside of the casing, or within the casing, up to the surface.

In a variation of the above-described embodiment, the hub (300) is autonomously powered by harvesting energy from its environment. Energy may be harvested from environmental sources including but not limited to the flow of fluids, vibrations, thermal energy, mechanical energy, electrical energy, and other energy fields. For example, energy from ambient vibrations could be converted to useful energy by an electrical, mechanical, or electromechanical device (301), e.g., piezo-electric component or spring, ratchet and pendulum. The vibrations could even be induced from mud flow turbulence created by a reed-like structure (303). Alternatively, a paddlewheel or turbine (304) connected with a DC motor or alternator could be driven by the mud flow. The hub may also include a memory (306) in which to record the data it acquires from the sensors. The hub may include an energy storage element (308) in order to power the memory to store data in the absence of the surface-connected transducer and fluid flow-based power. Data stored in the hub is later retrieved when desired by lowering the transducer (302) into the well proximate to the hub and initiating communication.

Figure 4:
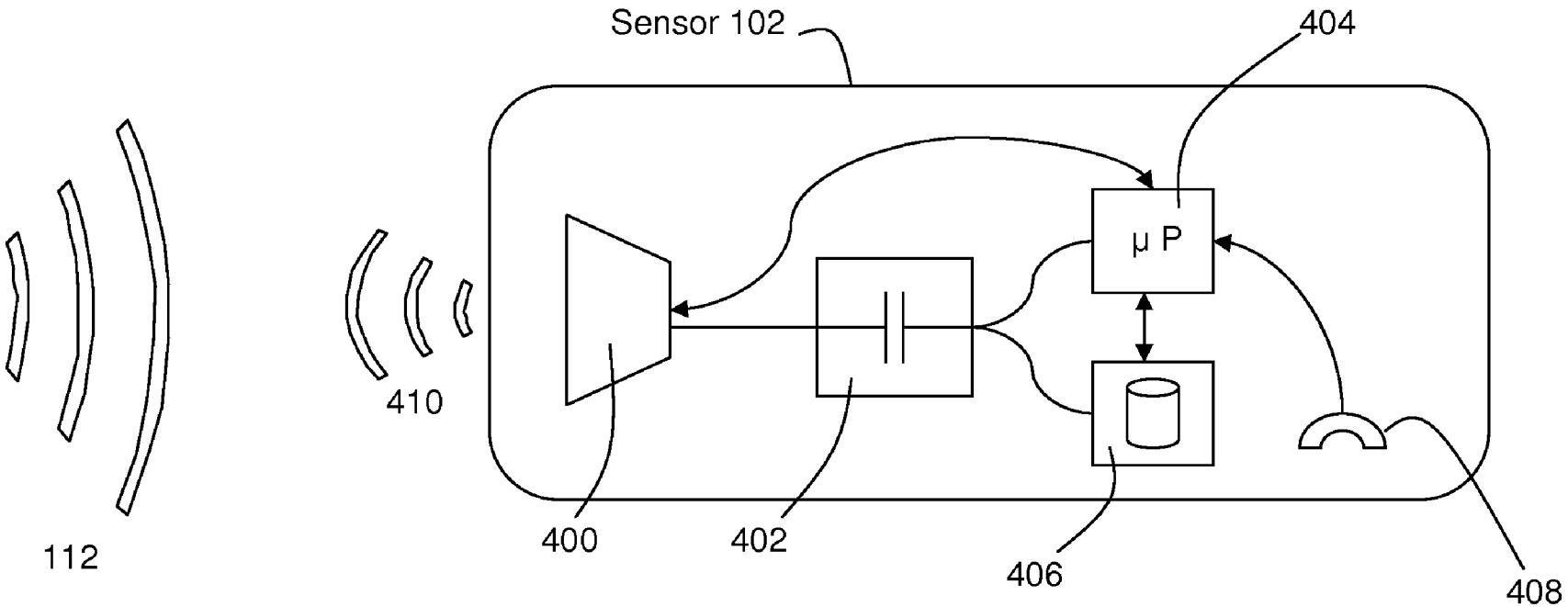
FIG. 4 illustrates one embodiment of the sensors of FIG. 1.

Referring now to FIGS. 1 and 4, one embodiment of a sensor (102) includes a transducer element (400), an energy storage element (402), a processor (404), a data storage element (406), and at least one sensing element (408). The sensing element (408) is operable for sensing certain physical parameters such as pressure, temperature, electrical resistivity, fluid flow rate and fluid composition, and also means for detecting changes in the state of the harboring equipment. The sensing element operates under control of the processor (404), which prompts both the taking of measurement data and the storage of that data in the data storage element (406). The energy storage element (402) is operable to provide power for operation of the other elements. The energy storage element may be, without limitation, a capacitive storage component. The transducer (400) is operable to receive and transmit elastodynamic waves (410). In order to provide such functionality, the transducer may include a piezoelectric component. In one mode of operation the transducer converts the received elastodynamic waves (112) to electrical energy which is stored by the energy storage element (402). Functioning in concert with the processor, the transducer is operable to transmit and receive data communications by modulation of elastodynamic waves, e.g., waves (410) and waves (112).

It should be noted that the sensor may be implemented with only a subset of the illustrated elements. For example, the sensor may not require data storage or energy storage if measurements are to be taken and communicated to the wave source at approximately the same time energy is being provided to the sensor. Further, the sensor may be implemented without a sensing element when only data forwarding capability is desired.

Figure 5:
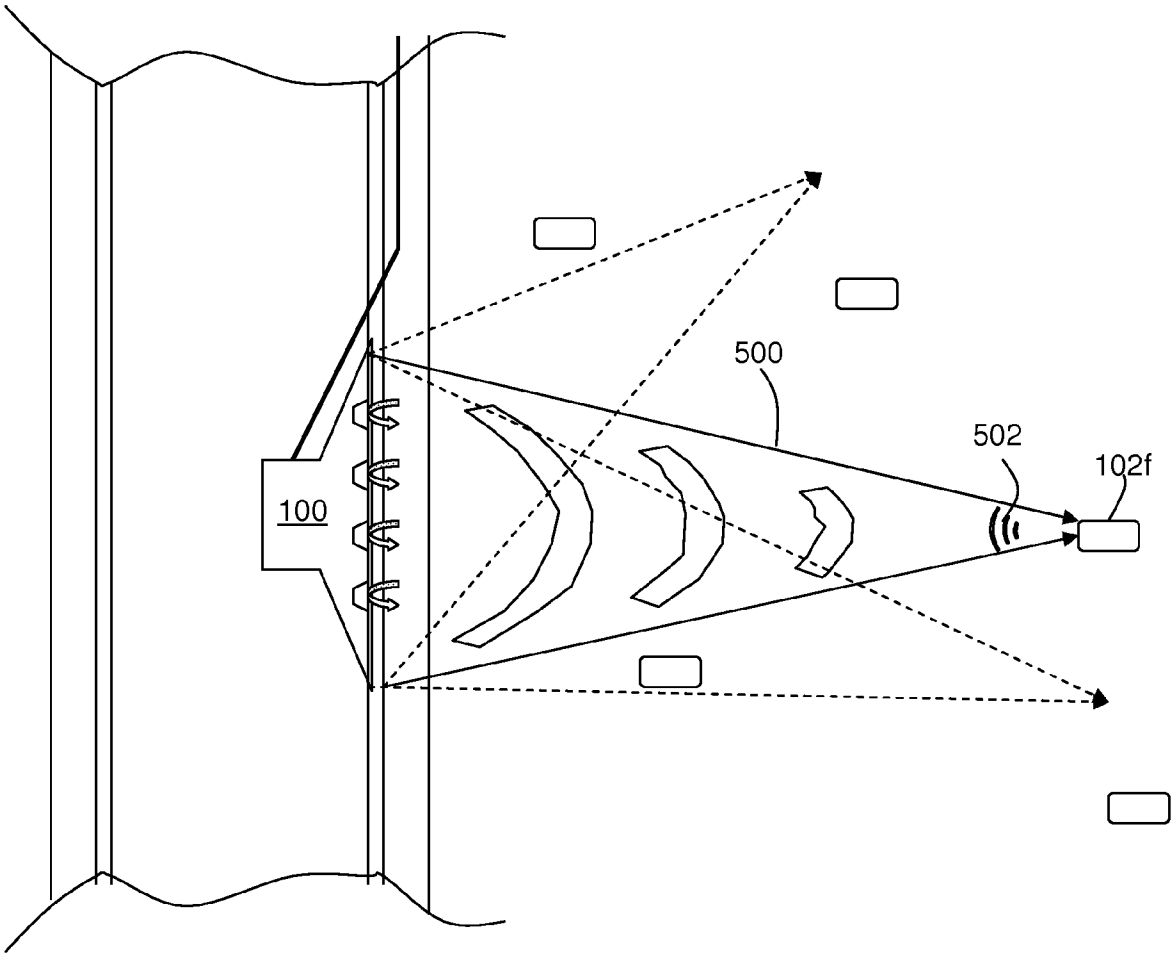
FIG. 5 illustrates delivery of power by wave focusing.

Referring now to FIG. 5, the spatial position of the sensors (102*a*-102*g*) relative to the hub (100) may not be known. In order to establish a communication/power link (500) between the hub and sensor (102*f*), the hub forms a relatively narrow beam of elastodynamic waves and steers that beam, sequentially, in the directions of which the hub is capable until sensor (102*f*) has been discovered. Once the sensor is discovered, it is powered and interrogated. This may be done repeatedly for each sensor each time a communication/power link is needed. Alternatively, a direction and focal length associated with each sensor may be recorded to facilitate establishment of future links. If the acoustic properties of the completion and formation are known, it may be possible to calculate and record the actual spatial position of the sensors in three dimensions. In an alternative embodiment, the waveforms received by each individual transducer of the hub transducer array are recorded in the hub, then reversed in time, amplified and played back through the same array elements. This method, known as inverse-scattering, allows focusing of the elastodynamic waves without prior knowledge of the geometry or the physical properties of the propagation media.

Referring to FIGS. 1 and 5, in one embodiment a two step process is utilized. In the first step the hub broadcasts a wide beam (See FIG. 1) which activates the sensors in a first mode of operation characterized by a low power consumption. In the low power mode the sensors accumulate energy coming from the hub, such as with electric charge stored in capacitors. When sufficient energy has been accumulated by a particular sensor, that sensor transmits elastodynamic waves (502) which are received by the hub. In response, the hub re-emits the received waves according to the inverse-scattering technique described above, resulting in a more focused link (See FIG. 5). Since the elastodynamic waves from the hub are more focused as a result of inverse-scattering, more energy is available to the sensor per unit time. In response, the sensor enters a second, high energy mode of operation which may include further power accumulation, data measurement and data communications.

Figure 6:
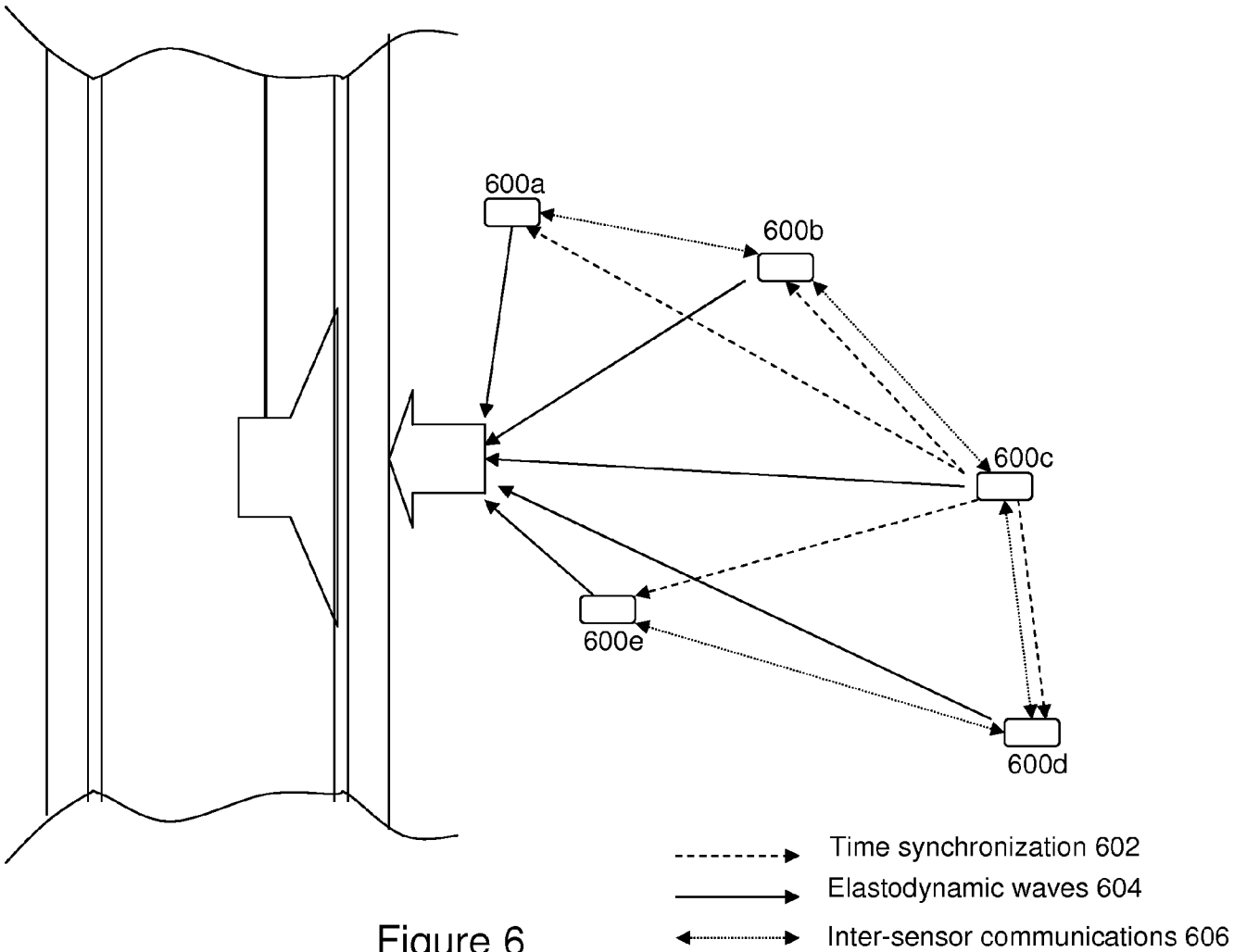
FIG. 6 illustrates the sensors forming a phased array for communicating with the elastodynamic wave source.

Referring now to FIG. 6, in yet another embodiment a cluster of several neighboring sensors (600*a*-600*e*) function cooperatively in an array. One of the sensors (600*c*) transmits time synchronization signals (602) to the other sensors in the cluster, preferably in the form of electromagnetic waves. These waves propagate quasi-instantaneously and without excessive attenuation over the moderate dimensions of the cluster. Each sensor of the array subsequently emits elastodynamic waves (604) which are suitably coordinated with respect to a common time reference in order to collectively focus their energy in the direction of the hub. The communications from the sensors may be identical, including the data from all of the sensors which will have been shared via previous inter-sensor communications (606), but are shifted in time so as to combine to produce a single signal of greater amplitude than its individual component signals. This method of beam forming may also be applied to the reception by the cluster of the information broadcast by a hub. Thus communication between hubs and clusters of sensors is possible over extended distances relative to independent communications from individual sensors.

Alternative network communication techniques may be employed depending upon environmental factors, deployment, and system requirements and capabilities. For example, communications from the sensors may be individual, i.e., each sending only its own data. These communications may be multiplexed on various bases, including but not limited to time, frequency and code.

Figure 7:
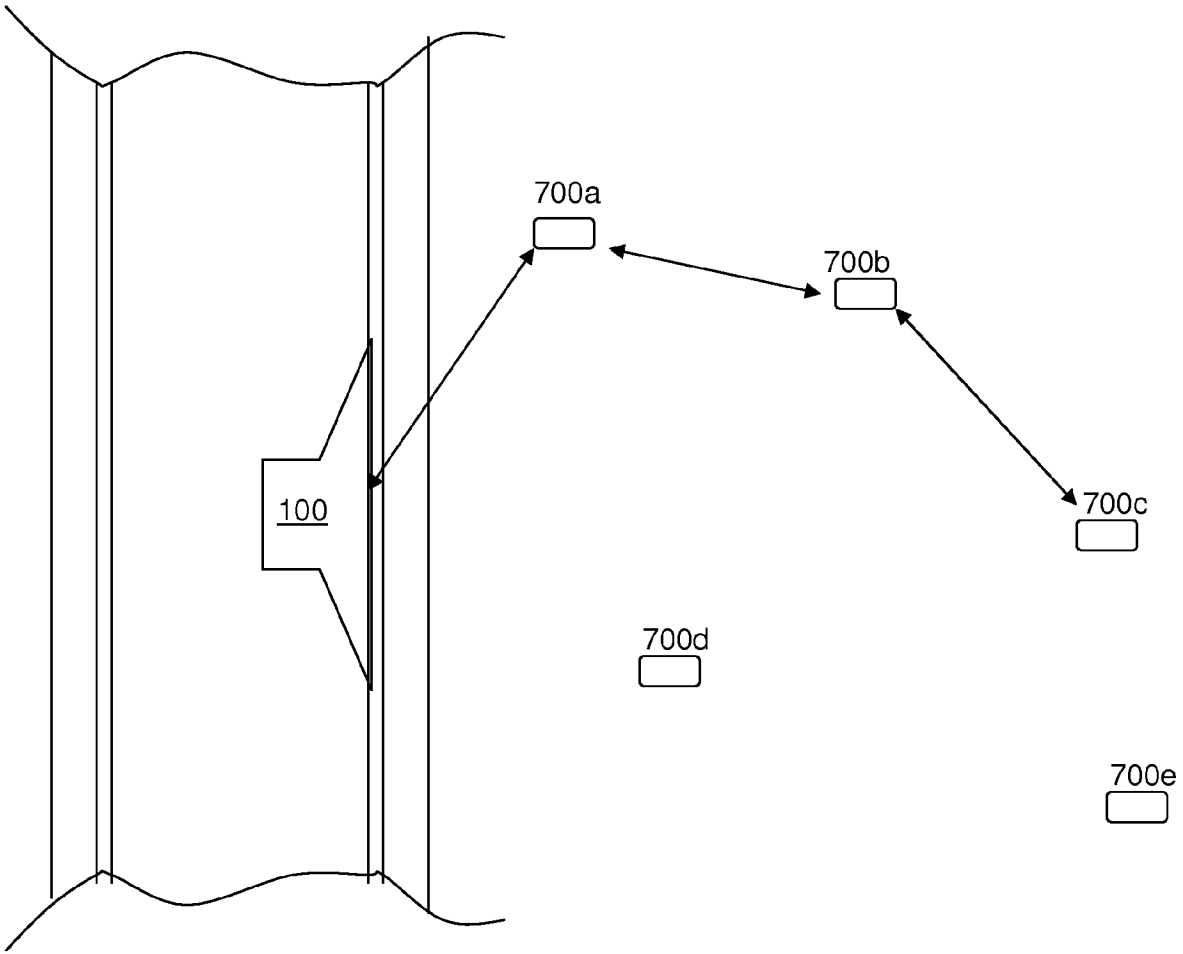
FIG. 7 illustrates downhole sensors in a mesh network configuration.

FIG. 7 illustrates an alternative embodiment for extending the communication range of sensors. In this embodiment the sensors (700*a*-700*e*) form a mesh network in which nearby sensors communicate with one another. In order to transmit data from a distant sensor (700*c*) to the hub (100), the data is transmitted along a path which includes multiple discreet hops between intervening sensors (700*b*, 700*a*). The mesh network of sensors may be connectionless or connection oriented, and may utilize protocols already known in network technology. The form of the communications may be either electromagnetic or elastodynamic. The hub may communicate with distant sensors via a multi-hop path, or by one of the techniques already described.

Figure 8:
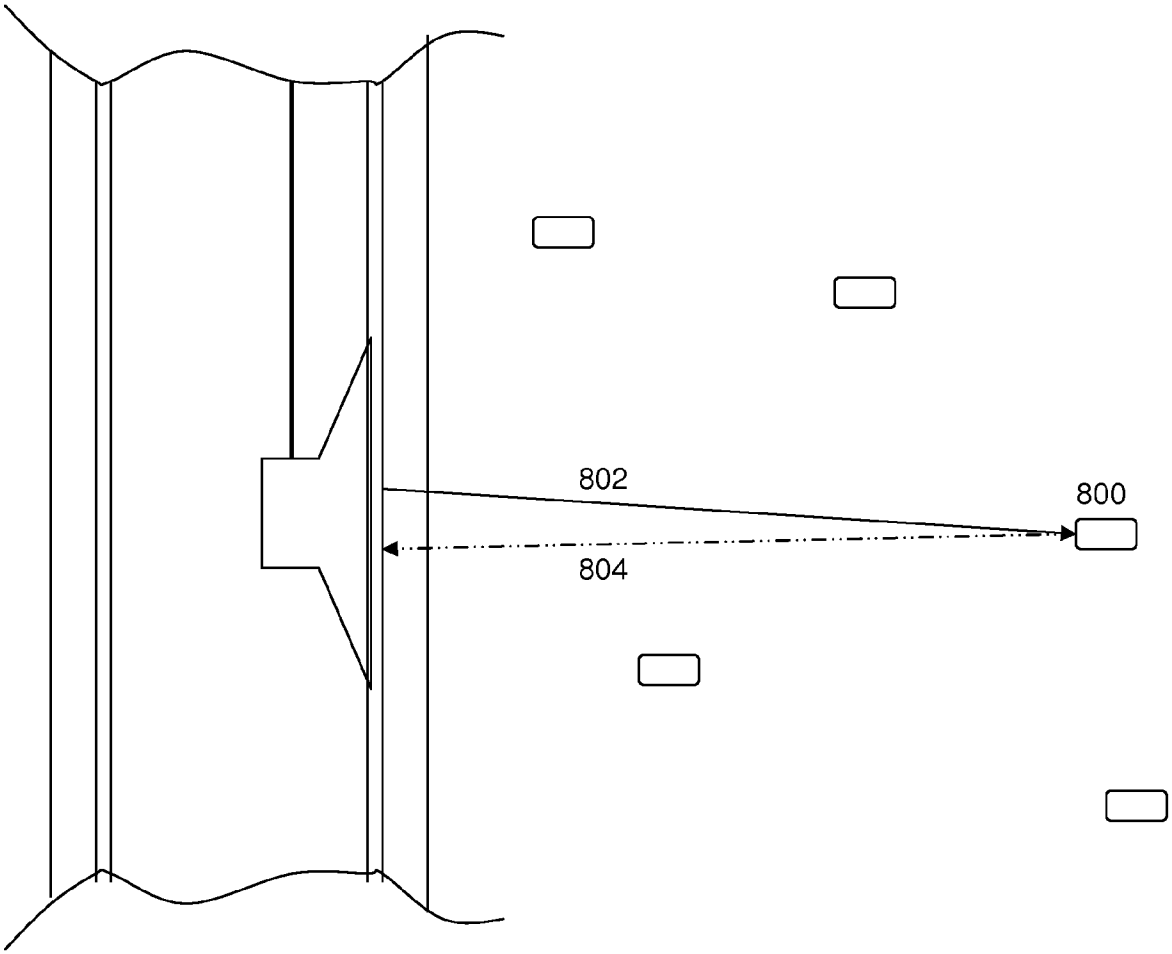
FIG. 8 illustrates a sensor utilizing a backscattering technique to communicate with the elastodynamic wave source.

FIG. 8 illustrates another alternative embodiment for communicating with a sensor. In this embodiment a backscattering technique is employed for communication. In particular, the sensor (800) does not originate a communication signal, but rather modulates a source signal (802) from the hub, and directs the modulated source signal (804) back toward the hub. One advantage of this technique is that it obviates the need for active transmission by the sensor.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the invention should not be viewed as limited except by the scope and spirit of the appended claims.

What is claimed is:

1. A wireless subterranean sensor network comprising:

at least one sensor, the at least one sensor including an elastodynamic transducer such that the at least one sensor is positioned in an outside of a well casing wherein the well casing is made of a material from the group consisting of one of a conductive material or a ferromagnetic material or some combination thereof;

a hub having a plurality of transducers arranged in an array capable of adjustable focus or adjustable directional emission; and wherein a link is formed between the at least one sensor and the hub by elastodynamic waves through at least one wall of the well casing such that the elastodynamic waves are adjustably controllable in one of focus, direction or both.

2. The network of claim 1 wherein the at least one sensor is operable to convert elastoclynamic waves received from the hub to electrical energy.

3. The network of claim 1 wherein the hub is operable to modulate elastodynamic waves transmitted by the hub such that data is communicated in those waves.

4. The network of claim 3 wherein the at least one sensor includes circuitry operable to receive the data communicated by the hub via modulated elastodynamic waves.

5. The network of claim 1 wherein the at least one sensor is operable to transmit modulated elastodynamic waves such that data is communicated in those waves.

6. The network of claim 5 wherein the hub is operable to receive the data communicated by the at least one sensor via modulated elastodynamic waves.

7. The network of claim 1 wherein the hub is affixed to a portion of a completion of a borehole.

8. The network of claim 1 wherein the elastodynamic waves are transmitted at ultrasonic frequency.

9. The network of claim 1 wherein the hub is proximate to the casing, and wherein the plurality of transducers are operable to transmit the elastodynamic waves at a half-wavelength approximately double equal to an integral sub-multiple of the casing thickness.

10. The network of claim 1 wherein the hub is proximate to the casing in a borehole, and further including a wireline device operable to be temporarily inserted into the borehole to establish a communication link between the hub and the surface.

11. The network of claim 1 wherein the hub includes a component operable to harvest from the environment energy selected from the group consisting of flow of fluids, vibrations, thermal energy, mechanical energy, electrical energy.

12. The network of claim 1 further comprising an energy storage component operable to store electrical energy.

13. The network of claim 1 further comprising a memory component operable to store data received from the at least one sensor.

14. The network of claim 1 wherein the at least one sensor includes a sensing element operable to sense a physical parameter.

15. The network of claim 1 wherein the hub is operable to establish the link by adjusting focus and direction of elastodynamic waves until the at least one sensor is located.

16. The network of claim 15 wherein the hub records the location of the at least one sensor.

17. The network of claim 1 wherein the hub is operable to establish the link by inverse-scattering based on elastodynamic waves received from the at least one sensor.

18. The network of claim 1 wherein the hub is operable to establish the link by providing power to the at least one sensor with a wide beam emission and, in response to receipt of elastodynamic waves received from the at least one sensor, inverse-scattering based on the received elastodynamic waves.

19. The network of claim 1 wherein the at least one sensor is a plurality of sensors configured as a phased array for transmitting data to the hub via the link.

20. The network of claim 19 wherein at least one of the plurality of sensors is operable to provide a time synchronization signal to other sensors of the phased array.

21. The network of claim 19 wherein each sensor of the plurality of sensors is operable to transmit at least one of identical data, group data or individual data.

22. The network of claim 21 wherein sensor transmissions are multiplexed on a basis selected from the group consisting of one of time, frequency code or some combination thereof.

23. The network of claim 1 wherein the at least one sensor is a plurality of sensors configured as a mesh such that data is transmitted to the hub via multiple hops to intervening sensors of the plurality of sensors.

24. The network of claim 1 wherein the at least one sensor communicates data to the hub by modulating elastoctynamic waves transmitted by the hub according to a backscattering technique.

25. A method for operating a wireless subterranean sensor network comprising:

providing at least one sensor, the at least one sensor including an elastodynamic transducer such that the at least one sensor is positioned in an outside of a casing wherein the casing is made of a material from the group consisting of one of a conductive material or a ferro-magnetic material or some combination thereof, and a hub having a plurality of transducers arranged in an array capable of adjustable focus or adjustable directional emissions, forming a link between the at least one sensor and the hub by elastodynamic waves through at least one wall of the casing such that the elastodynamic waves are adjustably controllable in one of focus, direction or both.

26. The method of claim 25 further including the step of the at least one sensor converting elastodynamic waves received from the hub to electrical energy.

27. The method of claim 25 further including the step of the hub modulating elastodynamic waves transmitted by the hub such that data is communicated in those waves.

28. The method of claim 27 further including the step of the at least one sensor receiving the data communicated by the hub via modulated elastodynamic waves.

29. The method of claim 25 further including the step of the at least one sensor transmitting modulated elastodynamic waves such that data is communicated in those waves.

30. The method of claim 29 including the step of the hub receiving the data communicated by the at least one sensor via modulated elastodynamic waves.

31. The method of claim 25 including the step of transmitting the elastodynamic waves at ultrasonic frequency.

32. The method of claim 25 wherein the hub is proximate to the casing, and including the step of the transducers transmitting the elastodynamic waves at a wavelength approximately double the casing thickness.

33. The method of claim 25 wherein the hub is proximate to the casing in a borehole, and further including the step of temporarily inserting a wireline device into the borehole to establish a communication link between the hub and the surface.

34. The method of claim 25 including the step of the hub harvesting from the environment energy selected from the group consisting of flow of fluids, vibrations, thermal energy, mechanical energy, electrical energy.

35. The method of claim 25 including the step of storing electrical energy.

36. The method of claim 25 including the step of storing data received from the at least one sensor via the link.

37. The method of claim 25 including the step of the at least one sensor sensing a physical parameter.

38. The method of claim 25 wherein the hub establishes the link by adjusting focus and direction of elastodynamic waves until the at least one sensor is located.

39. The method of claim 38 including the step of recording the location of the at least one sensor.

40. The method of claim 25 wherein the hub establishes the link by inverse-scattering based on elastodynamic waves received from the at least one sensor.

41. The method of claim 25 wherein the hub includes an the hub establishes the link by providing power to the at least one sensor with a wide beam emission and, in response to receipt of elastodynamic and waves received from the at least one sensor, inverse-scattering based on the received elastodynamic waves.

42. The method of claim 25 wherein the at least one sensor is a plurality of sensors configured as a phased array for transmitting data to the hub via the link.

43. The method of claim 42 including the step of at least one sensor of the plurality of sensors providing a time synchronization signal to other sensors of the phased array.

44. The method of claim 12 including the step of each sensor of the plurality of sensors transmitting one of identical data, group data or individual data.

45. The method of claim 25 including the step of multiplexing sensor transmissions on a basis selected from the group consisting of one of time, frequency code or some combination thereof.

46. The method of claim 25 wherein the at least one sensor is a plurality of sensors configured as a mesh and including the step of transmitting data to the hub via multiple hops to intervening sensors of the plurality of sensors.

47. The method of claim 25 Including the step of the at least one sensor communicating data to the hub by modulating elastodynamic waves transmitted by the hub according to a backscattering technique.

48. An apparatus for operating a wireless subterranean sensor network, the apparatus comprising:

at least one sensor, the at least one sensor including an elastodynamic transducer such that the at least one sensor Is positioned in an outside of a completion wherein the completion is made of a material from the group consisting of one of a conductive material or a ferromagnetic material or some combination thereof; and a hub having a plurality of transducers arranged in an array capable of adjustable focus or adjustable directional emission; and wherein elastodynamic waves form a link between the at least one sensor and the hub through at least one wall of the completion such that the elastodynamic waves are adjustably controllable in one of focus, direction or both.

* * * * *